US009440711B2

(12) United States Patent
Kutsen

(10) Patent No.: US 9,440,711 B2
(45) Date of Patent: Sep. 13, 2016

(54) SELF-SECURING, VERTICALLY MOUNTED MARINE ANCHOR STOWAGE DEVICE AND METHOD OF USE THEREOF

(71) Applicant: Gregory Kutsen, Seabrook, TX (US)

(72) Inventor: Gregory Kutsen, Seabrook, TX (US)

( * ) Notice: Subject to any disclaimer, the term of this patent is extended or adjusted under 35 U.S.C. 154(b) by 175 days.

(21) Appl. No.: 14/133,606

(22) Filed: Dec. 18, 2013

(65) Prior Publication Data

US 2015/0166146 A1 Jun. 18, 2015

(51) Int. Cl.
*B63B 21/22* (2006.01)

(52) U.S. Cl.
CPC ..... *B63B 21/22* (2013.01); *Y10T 29/49948* (2015.01)

(58) Field of Classification Search
CPC ..... B63B 21/22
USPC ..... 114/210
See application file for complete search history.

(56) References Cited

U.S. PATENT DOCUMENTS 4,248,171 A * 2/1981 Barbour ..... 114/210
4,479,452 A * 10/1984 Awalt, Jr. ..... 114/210
2010/0206209 A1* 8/2010 Ulgen ..... 114/210

* cited by examiner

*Primary Examiner* — Stephen Avila
(74) *Attorney, Agent, or Firm* — Richard J. Hepner

(57) ABSTRACT

A self-securing, vertically mounted marine anchor stowage device may comprise a bracket, forming a generally U-shaped channel and having an alignment guide designed and configured to capture the shaft of a marine anchor, a plurality of mounting slots which, in coordination with mounting hardware such as U-bolts, washers and nuts, enable the anchor stowage device to be mounted to a vessel, and a plurality of adjustment slots which, in coordination with bolt, washer and wing nut combinations, provides a means of adjustably mounting one or more rollers within the U-shaped channel, the bolts forming axes about which the rollers may rotate, the anchor stowage device being designed and configured to accommodate vertical stowage of an anchor by capturing the shaft of the anchor between the bracket and the one or more rollers, the anchor being held in the stowed condition solely by the force of gravity.

6 Claims, 4 Drawing Sheets

SELF-SECURING, VERTICALLY MOUNTED MARINE ANCHOR STOWAGE DEVICE AND METHOD OF USE THEREOF

FIELD OF THE INVENTION

The present invention relates generally to the field of marine anchors. More particularly, the present invention provides a useful and novel apparatus for stowing marine anchors.

BACKGROUND OF THE INVENTION

Unless specifically indicated otherwise, the materials described in this section are not prior art to the claims in this application, and are not admitted to be prior art by inclusion in this section.

The material in this patent document is subject to copyright protection under the copyright laws of the United States and other countries. The copyright owner grants a limited license to any member of the public to reproduce the patent document as it appears in official governmental records. All other copyrights rights are reserved.

Marine anchors are commonly used to secure a marine vessel to a mooring bed. A vessel may utilize one or more anchors for securing the bow of the vessel, and one or more anchors for securing the stern of the vessel. When a marine anchor is not in use, the anchor must be stowed on the vessel.

Some vessels may be equipped with anchor lockers or lazarettes that are designed specifically for the purpose of stowing an anchor, or that may be adapted to that purpose. Anchor lockers and lazarettes are compartments built beneath the hull of a vessel, and are generally accessible by means of a door or a hatch. Anchor lockers and lazarettes have the disadvantage that they do not provide for convenient access to the anchor. The door or hatch must be opened in order to access the stowed anchor, and the user must reach down into the anchor locker or lazarette to access the anchor and its rode. Another disadvantage of an anchor locker or lazarette is difficulty of use. The anchor and rode must be lifted out from its stowage location below the deck and carried to the position on the vessel where the anchor is to be deployed, typically the bow or the stern of the vessel. A further disadvantage of anchor lockers and lazarettes, which are built into the structure of the vessel, is that the anchor locker or lazarette may have a size limitation or shape factor that restricts the size or style of anchor that may be accommodated by the fixed, built in anchor locker or lazarette.

Anchor stowage devices have been developed as alternatives to anchor lockers and lazarettes, for vessels that do not have anchor lockers or lazarettes and/or to overcome the disadvantages of anchor lockers and lazarettes.

One category of conventional anchor stowage devices, commonly called anchor davits, are designed to project beyond the deck and hull of a vessel and to stow the anchor in a horizontal orientation. These anchor davit devices are typically intended for use at the bow of a vessel. A representative anchor davit design is disclosed in U.S. Pat. No. 5,996,524 to Johnson. Johnson discloses an anchor davit comprising an elongated U-shaped frame for receiving a main shank of an anchor; a roller at the outboard end of the frame for guiding the anchor line as the anchor is lowered or raised; a smooth round rod means at the outboard end of the frame for providing chafe protection of an anchor line; and means at a rear portion of the U-shaped frame for securing the frame to a bow, a deck, a gunnel, or another structural member of a boat. Anchor davit devices share the disadvantage that they take up deck space to the extent that the devices are mounted on the deck, and/or they increase the effective length of the vessel to the extent that they extend forward of the bow of the vessel. This disadvantage renders davit-style anchor stowage devices particularly undesirable for stowage of anchors at the stern of the boat, where deck space in the cockpit area is at a premium and where protrusions outboard of the hull and/or deck are inconvenient. A further disadvantage of davit-style anchor devices is the absence of a means for securely holding the shaft of an anchor in a manner that prevents shifting and rattling of the anchor.

Other anchor stowage designs attempt to address the shortcomings of the davit-style anchor devices, especially for use with stern anchors. However, each of these designs possess disadvantages of their own.

U.S. Pat. No. 4,479,452 to Awalt discloses a storage device for a swivel-fluke-type marine anchor comprising a shank-receiving boom and a fluke channeling member both being rotatably mounted to the stern of a vessel, in combination with a back plate fixedly mounted to the stern of the vessel. To capture a swivel-fluke-type marine anchor, the shank-receiving book and fluke channeling member are rotated to extend horizontally outboard from the stern of a vessel. Once captured, the anchor is stowed by rotating the shank-receiving book and fluke channeling member to a vertical stowage position against the back plate. One obvious disadvantage of the invention of Awalt is that it is designed to accommodate one particular anchor design type: a swivel-fluke-type marine anchor. This disadvantage, the lack of compatibility with a variety of marine anchor types, is typical of most conventional marine anchor stowage devices. Another disadvantage of the invention of Awalt is complexity. This design complexity drives complexity of use. To release an anchor, rode is released from a bit arm, a locking pin must be removed from a locking arm. A control force lever arm must be depressed causing the fluke receiving channel to project outwardly away from the vessel, and the frame rotates to its deployed position. The anchor is then in position to be deployed. A similar level of complexity is involved in capturing and stowing the anchor. In addition to driving complexity of installation and use, design complexity drives cost.

U.S. Pat. No. 4,164,194 to Kurz discloses an anchor stowage device that is designed to suspend an anchor above the deck of a vessel. The invention of Kurz comprises a base support affixed to the deck of the vessel and a bracket attached to a railing above the deck. To stow a swivel-fluke-type marine anchor, the stabilizing bar of a swivel-fluke-type anchor is inserted into channels in the base support, the shank of the anchor is then inserted into a channel in the bracket, a locking feature is rotated to close the opening of the channel in the bracket, and a wing nut is tightened onto a threaded stud in order to secure the locking feature such that the anchor cannot come out of the channel. The invention of Kurz is limited to use with a swivel-fluke-type marine anchor. A further disadvantage of the invention of Kurz is that the stowed anchor takes up deck space. An additional advantage is the need to release the wing nut in order to deploy an anchor, and to install and tighten the wing nut in order to stow an anchor. This unfastening/fastening step is inconvenient, particularly where quick deployment of an anchor is desired, and the lose wing nut hardware is subject to being dropped into the vessel or overboard.

As is readily apparent from a review of conventional anchor stowage device designs, what is needed is an anchor stowage device that is simple in design and use and may be rapidly deployed, that minimizes use of valuable deck space, and is capable of accommodating a variety of marine anchor types, including, but not in a limiting sense, fluke-style anchors, claw-style anchors and plow-style anchors.

SUMMARY OF THE INVENTION

In view of the foregoing limitations and disadvantages inherent to the conventional apparatus in the related art, the present invention provides a useful and novel apparatus [hereinafter "anchor stowage device"] for stowing a marine anchor.

A principal objective of the present invention is to provide a simple anchor stowage device that may accommodate vertical stowage of a marine anchor for rapid deployment without the need to fasten or unfasten hardware during stowage or deployment of the anchor.

In one aspect, the present invention provides a self-securing, vertically mounted marine anchor stowage device comprising a bracket, forming a generally U-shaped channel and having an alignment guide designed and configured to capture the shaft of a marine anchor, a plurality of mounting slots which, in coordination with mounting hardware such as U-bolts, washers and nuts, enable the anchor stowage device to be mounted to a vessel, and a plurality of adjustment slots which, in coordination with bolt, washer and wing nut combinations, provides a means of adjustably mounting one or more rollers within the U-shaped channel, the bolts forming axes about which the rollers may rotate, the anchor stowage device being designed and configured to accommodate vertical stowage of an anchor by capturing the shaft of the anchor between the bracket and the one or more rollers, the anchor being held in the stowed condition solely by the force of gravity. The anchor and its rode may remain fully rigged and ready to deploy.

A further object of the present invention is to provide an anchor stowage device that is simple to use.

In one aspect, to deploy an anchor that is stowed in the anchor stowage device of the present invention, a user may simply grasp the anchor and lift the anchor in a vertical direction and out of the anchor stowage device, thereby also causing the rode to deploy vertically through the channel formed by the bracket. The anchor and rode may then be lowered into the water. In a further aspect, to stow an anchor in the anchor stowage device of the present invention, a user may simply take in the rode, allowing the rode to fall downward through the channel formed by the bracket, grasp the raised anchor, and vertically lower the anchor such that the shaft of the anchor may be captured between the bracket and the one or more rollers of the anchor stowage device by the force of gravity, the shaft further held in alignment within the bracket by means of the alignment guide.

Another object of the present invention is to minimize use of valuable deck space aboard a vessel.

In one aspect, the present invention may be mounted outboard of the vessel, on the railings or hull of the vessel, thereby leaving the inboard space of the vessel unencumbered.

A further object of the present invention is to provide an anchor stowage device that is capable of accommodating a variety of marine anchor types.

In one aspect, the one or more rollers of the anchor stowage device of the present invention may be adjusted to accommodate any anchor shaft design. Additionally, the alignment guide may provide a plurality of features, such as alignment slots and V-grooves, to guide and capture any anchor shaft design.

Other objects, aspects and advantages of the present invention will become readily apparent to those with skill in the art from the following figures, descriptions and claims. As will be appreciated by those with skill in the related art, the invention may be implemented in a plurality of equivalent embodiments. Such alternative embodiments, and their attendant objects, aspects and advantages, are within the scope of the present invention and, therefore, the examples set forth herein shall not be limiting.

BRIEF DESCRIPTION OF THE DRAWINGS

The nature of this invention, as well as all its objects, aspects and advantages, will become readily apparent and understood upon reference to the following detailed description when considered in conjunction with the accompanying drawings, in which like reference numerals designate like parts throughout the figures thereof, and wherein.

DETAILED DESCRIPTION OF THE INVENTION

The following description is provided to enable a person skilled in the relevant art to make and use the invention, and sets forth the best modes contemplated by the inventor of carrying out the invention. The present invention shall not be limited to the examples disclosed. Rather, the scope of the invention shall be as broad as the claims will allow.

Various inventive features are described below that may each be used independently of one another or in combination with other features. However, any single inventive feature may not address any of the disadvantages or objects discussed above, or might address only one of the disadvantages or objects discussed above. Further, one or more of the disadvantages or objects discussed above may not be fully addressed by any of the features described below.

Figure 1:
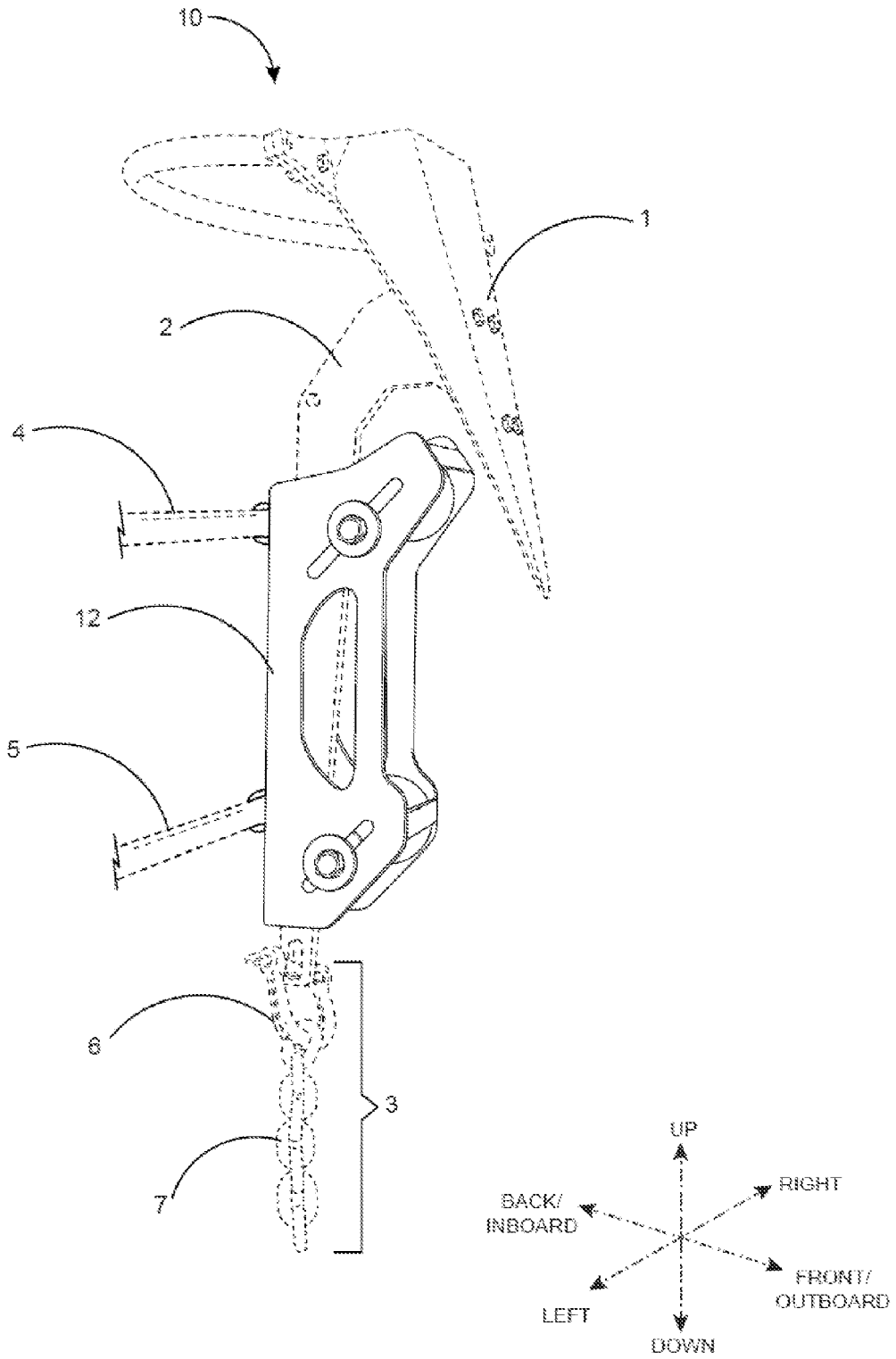
FIG. 1 presents a front/left side perspective view of an anchor stowage device 10 shown in use according to one exemplary embodiment of the present invention.
Figure 2:
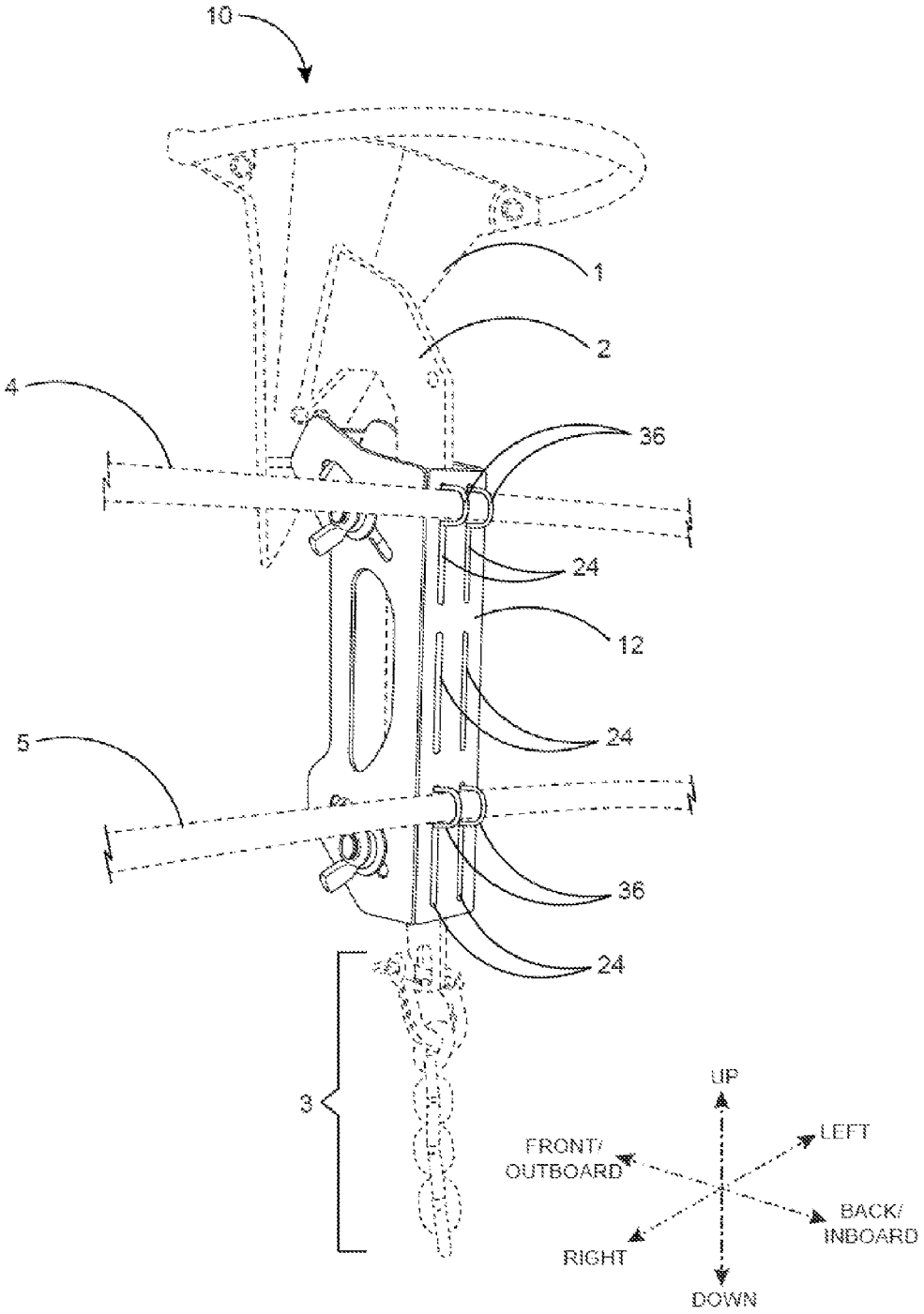
FIG. 2 presents a rear/right side perspective view of the anchor stowage device 10 of FIG. 1 shown in use.

Referring now to the drawings, FIG. 1 presents a front/left side perspective view of an anchor stowage device 10 shown in use according to one exemplary embodiment of the present invention. FIG. 2 presents a rear/left side perspective view of the anchor stowage device 10 in use. An anchor stowage device 10 may be attached to the upper railing 4 and lower railing 5 of a vessel by means of a plurality of U-bolts 36 secured through a plurality of mounting slots 24 in the bracket 12 of the anchor stowage device 10. An anchor 1 is shown in its stowed position, with the shaft 2 of the anchor 1 secured within the anchor stowage device 10 with the shaft 2 in a generally vertical orientation. An anchor rode 3, which may be employed to establish a load path between the anchor 1 and the vessel, is shown attached to the shaft 2 of the anchor 1. An anchor rode 3 may typically comprise a rope (not shown) that may be secured to a vessel, a chain 7 to provide weight and strength to the portion of the rode 3 proximal to the anchor 1, and a shackle 6 to attach the chain 7 to the shaft 2 of the anchor 1.

Figure 3:
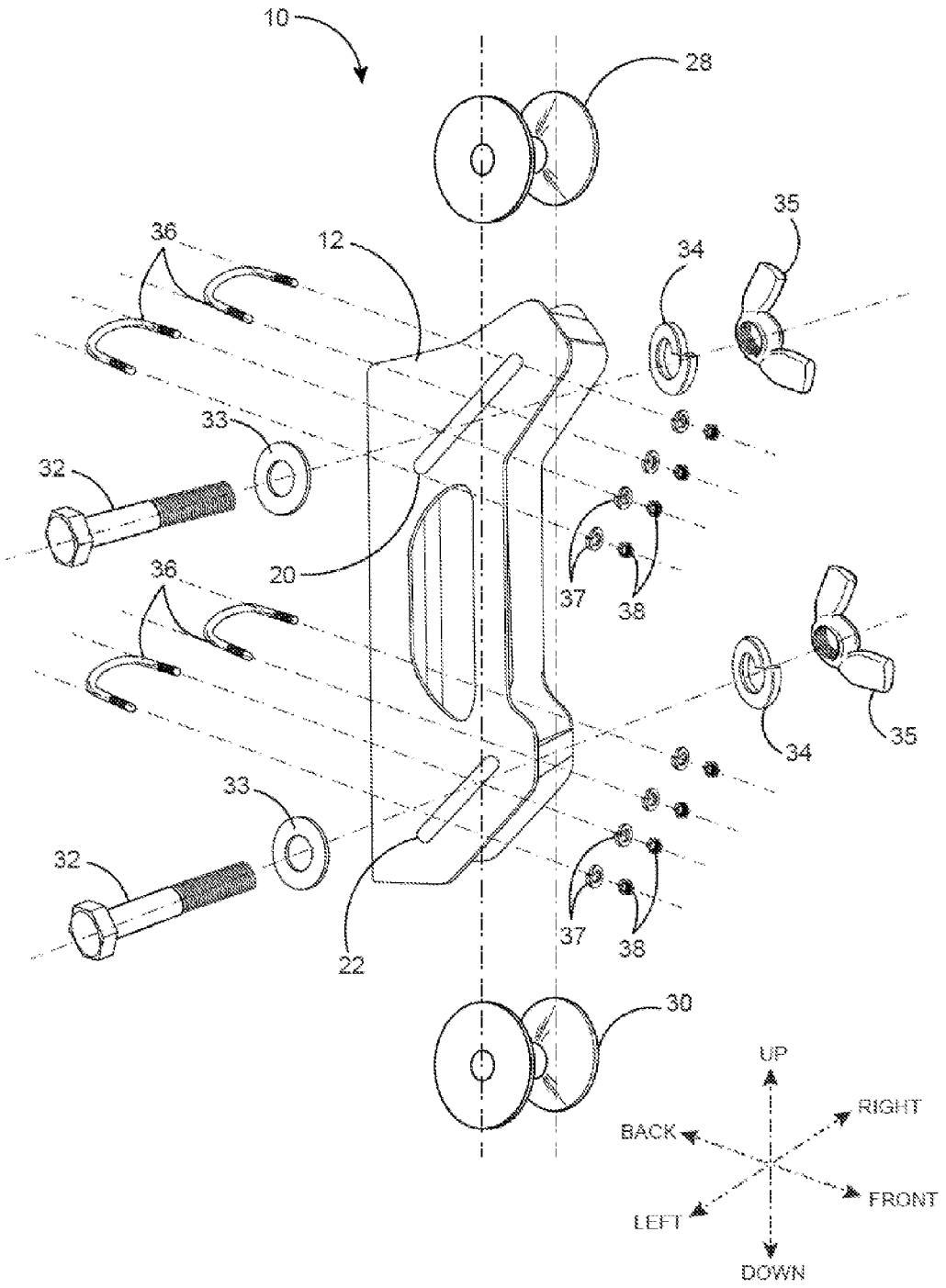
FIG. 3 presents an exploded perspective view of the anchor stowage device 10 of FIG. 1.

FIG. 3 presents an exploded perspective view of the anchor stowage device 10, according to one exemplary embodiment of the invention. A bracket 12 may have a back side, a left side and a right side, forming a generally U-shaped channel. The back side of the bracket 12 may have a set of mounting slots 24. A plurality of U-bolt/lock washer/nut combinations 36/37/38 may be utilized for mounting the bracket 12 to the railings of a vessel. The right side and left side of the bracket 12 may each have a upper adjustment slot 20 and a lower adjustment slot 22. An upper roller 28 may be mounted between the left side and the right side of the bracket 12 by means of a bolt/washer/lock washer/wing nut combination 32/33/34/35. The bolt 32 may pass through the upper adjustment slots 20 of the bracket 12 and form an axle about which the upper roller 28 may rotate. Similarly, a lower roller 30 may be mounted between the left side and the right side of the bracket 12 by means of a bolt/washer/lock washer/wing nut combination 32/33/34/35. The bolt 32 may pass through the lower adjustment slots 22 of the bracket 12 and form an axle about which the lower roller 30 may rotate.

Figure 4:
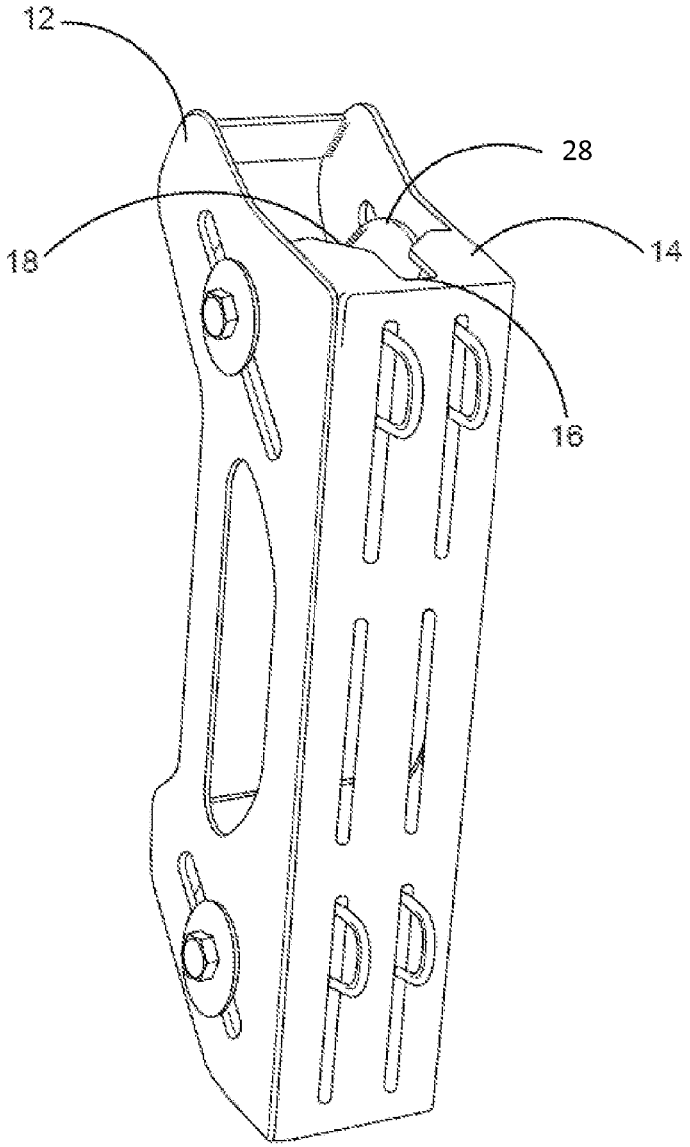
FIG. 4 presents a rear right side perspective view of the anchor stowage device 10 of FIG. 1.

FIG. 4 presents a rear right side perspective view of the anchor stowage device 10 showing an alignment guide 14 structurally integrated to the top of the bracket 12. The alignment guide 14 may have one or more features designed and configured to align and capture the shaft of an anchor within the anchor stowage device 10. In the present exemplary embodiment, the alignment guide may have an alignment slot 16 designed and configured to capture the shaft of an anchor having a relatively flat shaft design, and a V-groove 18 designed and configured to capture the shaft of an anchor having a non-flat shaft design.

Alternative embodiments of the present invention may implement the anchor shaft capture function in a number of alternative ways. For example, but not in a limiting sense, there may be a plurality of alignment guides positioned along the length of the interior channel of the bracket 12, or there may be a single alignment guide that extends along the length of the interior channel of the bracket 12.

The bracket 12 may be made from stainless steel for a combination of strength and corrosion resistance, or from any other material that is appropriate to the intended use of the bracket 12. The upper roller 28 and the lower roller 30 may be made from a rubber or polymeric material selected to provide a relatively soft gripping interface between the rollers 28/30 and the shaft 2 of an anchor 1, or from any other material that is appropriate to the intended use roller 28/30.

In alternative embodiments of the present invention, fastening/mounting means may be used to secure the bracket 12 to the vessel, including, but not in a limiting sense, screws, studs, bolts and nuts, and clamps. Further, the mounting slots may be mounting holes, or no mounting slots/holes may be required at all as in the case of, for example, an alternative design wherein studs may be welded to the bracket 12.

In alternative installations, the anchor stowage device may be mounted to any available and useful structure of a vessel. For example, the bracket 12 may be attached to the hull of the vessel using appropriate fastening means such as bolts or screws. The bracket 12 may be secured to horizontal or vertical railings, or to a combination of both. The bracket 12 may be mounted inboard or outboard, although an outboard location might be preferred in order to keep the inboard space clear.

In the stowed condition, illustrated in FIG. 1 and FIG. 2, the shaft 2 of an anchor 1 may be captured between the bracket 12, the upper roller 28 and the lower roller 30, the shaft further held in alignment within the bracket 12 by means of the alignment guide 14. The shaft 2 of the anchor 1 may be held in place vertically by the force of gravity. One end of the rode 3 may be attached to the end of the shaft 2 of the anchor 1; the other end of the rode 3 may be secured to the vessel (not shown). The upper roller 28 and the lower roller 30 may be adjusted to fit a particular anchor shaft by moving the bolts 32 along the upper adjustment slots 20 and the lower adjustment slots 22 until the desired fit is achieved. The bolts 32 may be secured in the desired locations by tightening the wing nuts 35. Once the upper and lower rollers 28/30 are adjusted for a particular anchor, they need not be relocated again. Therefore, the anchor may be removed and stowed repeatedly without requiring any manipulation of the anchor stowage device 10 hardware.

To deploy the anchor 1, a user may simply grasp the anchor 1 and lift the anchor 1 in a vertical direction and out of the anchor stowage device 10, thereby also causing the rode 3 to deploy vertically through the channel formed by the bracket 12. The anchor 1 and rode 3 may then be lowered into the water.

To stow the anchor 1, a user may simply take in the rode 3, allowing the rode 3 to fall downward through the channel formed by the bracket 12, grasp the raised anchor 1, and vertically lower the anchor such that the shaft 2 of the anchor 1 may be captured between the bracket 12, the upper roller 28 and the lower roller 30 by the force of gravity, the shaft further held in alignment within the bracket 12 by means of the alignment guide 14.

As will be appreciated by those with skill in the related arts, the elements of the present invention may be modified, interchanged, separated or combined, or additional elements added without departing from the spirit of the invention. The invention may be practiced in alternative embodiments other than those illustrated in the Figures. Such modifications, combinations, additions and alternatives are within the contemplation of the present invention. The exemplary embodiments and disclosed are not intended to limit the scope of this invention. Accordingly, the scope of the invention should be determined not by the embodiments illustrated, but by their legal equivalents, and shall be as broad as the claims will allow.

What is claimed is:

1. A self-securing, vertically mounted marine anchor stowage device, comprising:

a bracket, having:

an upper end, a lower end, a back side, a left side, and a right side, and forming a channel to accept the shaft of a marine anchor;

a plurality of adjustment slots passing through said left side and said right side; and an alignment means for aligning said shaft of said marine anchor within said bracket;

an upper roller, mounted proximal to said upper end of said channel between said left side and said right side, by means of a bolt/nut fastener combination working in cooperation with said plurality of adjustment slots;

a lower roller, mounted proximal to the lower end of said channel between said left side and said right side, by means of a bolt/nut fastener combination working in cooperation with said plurality of adjustment slots; said upper roller and said lower roller working in combination with said bracket to secure said marine anchor in a vertical orientation; and a plurality of fasteners for attaching said bracket to a vessel, said plurality of fasteners comprising a plurality of U-bolt/nut combinations arranged in vertically-spaced combinations.

2. The self-securing, vertically mounted marine anchor stowage device of claim 1, having a single roller.

3. The self-securing, vertically mounted marine anchor stowage device of claim 1, wherein the number of rollers is greater than two.

4. The self-securing, vertically mounted marine anchor stowage device of claim 1, wherein said alignment means is a slot.

5. The self-securing, vertically mounted marine anchor stowage device of claim 1, wherein said alignment means is a V-groove.

6. A method of vertically stowing a marine anchor, comprising the steps of:

a) providing a self-securing, vertically mounted marine anchor stowage device, comprising:

a bracket, having:

an upper end, a lower end, a back side, a left side, and a right side, and forming a channel to accept the shaft of a marine anchor;

a plurality of adjustment slots passing through said left side and said right side; and an alignment means for aligning said shaft of said marine anchor within said bracket;

an upper roller, mounted proximal to said upper end of said channel between said left side and said right side, by means of a bolt/nut fastener combination working in cooperation with said plurality of adjustment slots;

a lower roller, mounted proximal to the lower end of said channel between said left side and said right side, by means of a bolt/nut fastener combination working in cooperation with said plurality of adjustment slots; said upper roller and said lower roller working in combination with said bracket to secure said marine anchor in a vertical orientation; and a plurality of fasteners for attaching said bracket to a vessel;

b) mounting said bracket to a vessel in a vertical orientation; and c) adjusting the position of said upper roller and said lower roller in relation to said bracket, by means of said bolt/nut fastener combinations, such that said upper roller and said lower roller may secure the shaft of a marine anchor in a vertical orientation within said channel; and d) lowering a marine anchor into said channel such that the shaft of said marine anchor is captured between said upper roller, said lower roller, and said alignment means, and held in position by the force of gravity.

* * * * *